US005294405A

United States Patent [19]

Kenney

[11] Patent Number: 5,294,405

[45] Date of Patent: Mar. 15, 1994

[54] ADJUSTABLE VALVE FOR PIPETTE GUN

[75] Inventor: James W. Kenney, Broomall, Pa.

[73] Assignee: Drummond Scientific Company, Broomall, Pa.

[21] Appl. No.: 866,001

[22] Filed: Apr. 9, 1992

[51] Int. Cl.[5] ..... B01L 3/02; B65B 3/18

[52] U.S. Cl. ..... 422/103; 73/864.02; 73/864.13; 137/512.1; 137/515.5; 141/21; 141/267; 422/100

[58] Field of Search ..... 422/103, 114, 115, 100; 73/203, 265, 250, 863.72, 864.13, 864.14, 864.02; 141/21, 267; 137/512.1, 515.5, 516.11; 251/206, 319, 324, 325

[56] References Cited

U.S. PATENT DOCUMENTS

| | | | |
|---|---|---|---|
| 3,093,155 | 6/1963 | Dawes | 137/516.11 |
| 3,267,736 | 8/1966 | Boettger | 73/863.72 |
| 3,411,525 | 11/1968 | Auger | 73/863.72 |
| 3,724,504 | 4/1973 | Matsui et al. | 251/325 |
| 3,963,061 | 6/1976 | Kenney | 73/425.4 |
| 4,194,534 | 3/1980 | Lawrence et al. | 251/325 |
| 4,364,407 | 12/1982 | Hilliard | 137/515.5 |
| 4,543,980 | 10/1985 | van der Sanden | 137/512.1 |
| 4,624,147 | 11/1986 | Kenney | 73/864.15 |
| 4,795,336 | 1/1989 | Shannon et al. | 425/543 |
| 5,105,851 | 4/1992 | Fogelman | 73/863.72 |

*Primary Examiner*—James C. Housel
*Assistant Examiner*—Ramon Torres
*Attorney, Agent, or Firm*—Dann, Dorfman, Herrell and Skillman

[57] ABSTRACT

A valve for use in a pipette gun for selectively providing different ranges of flow rates through a pipette cooperating with the pipette gun. The valve has a predetermined number of discrete settings, each of which provides a range of fluid flow rates between zero and a different maximum flow rate. The operator controls the flow rate by depressing the gun trigger a selected distance. To change the flow rate setting, the operator simply rotates the gun trigger to a desired setting. The present valve also eliminates the "piston effect" of prior art valve elements by isolating the pipette chamber while the valve element operably slides in and out of engagement with a port thereby connecting the pipette with a fluid source either under pressure or at a vacuum.

20 Claims, 3 Drawing Sheets

ADJUSTABLE VALVE FOR PIPETTE GUN

FIELD OF THE INVENTION

The present invention relates to a valve for use in a pipette gun for variably controlling the flow of liquid samples through a pipette.

BACKGROUND OF THE INVENTION

It is known in the prior art to provide a pipette gun to replace the dangerous and often prohibited practice of mouth pipetting liquid samples. A typical pipette gun comprises a hand-held unit in communication with a laboratory pipette at one end and connected to either a remote or local air pressure source at the other end. A valve located within the pipette gun regulates the flow of air through the gun and to the pipette to control either the intake or expulsion of liquid through the pipette. The operator regulates air flow to the pipette by depressing either the positive pressure trigger or negative pressure trigger on the pipette gun. The magnitude of the pressure is predetermined and controlled by the valve located within the pipette gun housing.

Some pipette guns are provided with a universal nose piece attachment for cooperating and communicating with pipettes of various lengths and diameters. It is necessary for practical use of such pipette guns to provide variable flow rates to accommodate the different pipettes. For example, while a low flow rate is preferred for precise metering of liquid samples in small pipettes, a low flow rate is inefficient for larger pipettes. The range of flow rates of the pipette gun valve thereby effectively limits the size range of pipettes with which the pipette gun may be used practically.

The advantages of a pipette gun which can variably control the liquid flow rate through the pipette are recognized in the prior art. For example, it is known to variably control the air pressure at the pressure source by putting a speed control on the pressure pump. When an operator increases the motor speed, however, the pump diaphragm jerks irregularly and causes a temporary irregular flow rate through the pipette.

It is known and recognized in Kenney U.S. Pat. No. 3,963,061, to provide a pipette gun having an adjustable valve for continuously variably controlling the pressure applied to the pipette from a constant pressure source and, thus, continuously variably controlling the liquid flow rate through the pipette. The operator controls the liquid flow rate through the pipette by limiting the extent to which the trigger on the gun is depressed. In this manner the operator can rapidly fill or void a major portion of the pipette by depressing the trigger fully and then slowly meter the pipette by depressing the trigger slightly.

The type of pipette gun provided by Kenney improves on the prior art and is useful for many applications. The full range of liquid flow rates is achieved over the action path of the trigger. Due to the wide range of liquid flow rates and the limited action path of the trigger, however, slight deflections of the trigger in Kenney produce significant changes in the liquid flow rate. Limiting the range of flow rates for a particular trigger path of action makes the trigger less sensitive but limits the usefulness and efficiency of the pipette gun. It is therefore an object of the present invention to provide a pipette gun having a wide range of liquid flow rates which can be easily and precisely controlled by the pipette gun triggers.

Additionally the pipette gun in Kenney has limited use where extremely precise metering of small pipettes is required. The piston-like movement of the valve stem within its valve chamber causes small pressure changes in the pipette as the valve moves into and out of registry with pressure source. These slight pressure fluctuations adversely affect the liquid level in the pipette after releasing or initially depressing the trigger of the pipette gun. This problem is amplified when using small pipettes. It is therefore another object of the present invention to provide a valve whose constructions eliminates the "piston-effect" during operation.

SUMMARY OF THE INVENTION

The present invention provides a valve for use in a pipette gun having several range settings for variably controlling the flow of liquid samples through a pipette. The gun has separate triggers for activating the flow of negative and positive pressure to the pipette. The magnitude of the pressure is controlled by depressing one of the two triggers which are operably connected to the valve. The valve may be adjusted by simply rotating one of the gun triggers to select one of several ranges of flow rates for that particular trigger which may regulate either the positive or negative pressure source. Each setting changes the range of liquid flow rates provided over the action path of the selected trigger.

The valve of the present invention is an improvement over other valves having a single predetermined range of flow rates through a pipette. The present valve can be adjusted to be more or less sensitive to small deflections of the gun trigger. Each setting provides a range of flow rates from zero to a different maximum flow rate. Preferably the settings are arranged in an ordered sequence to provide a progression of maximum flow rates as the trigger is rotated in either direction.

The pipette gun of the present invention eliminates the "piston effect" of prior art valves which facilitates more precise metering of the pipette. Due to its construction, the controlling valve element moves tangential to any opening connecting the valve chamber with the pipette. The volume of air connected to the pipette thereby remains substantially unchanged as the controlling valve element slides into and out of registry to connect the air pressure source to the pipette.

DESCRIPTION OF A PREFERRED EMBODIMENT

Figure 1:
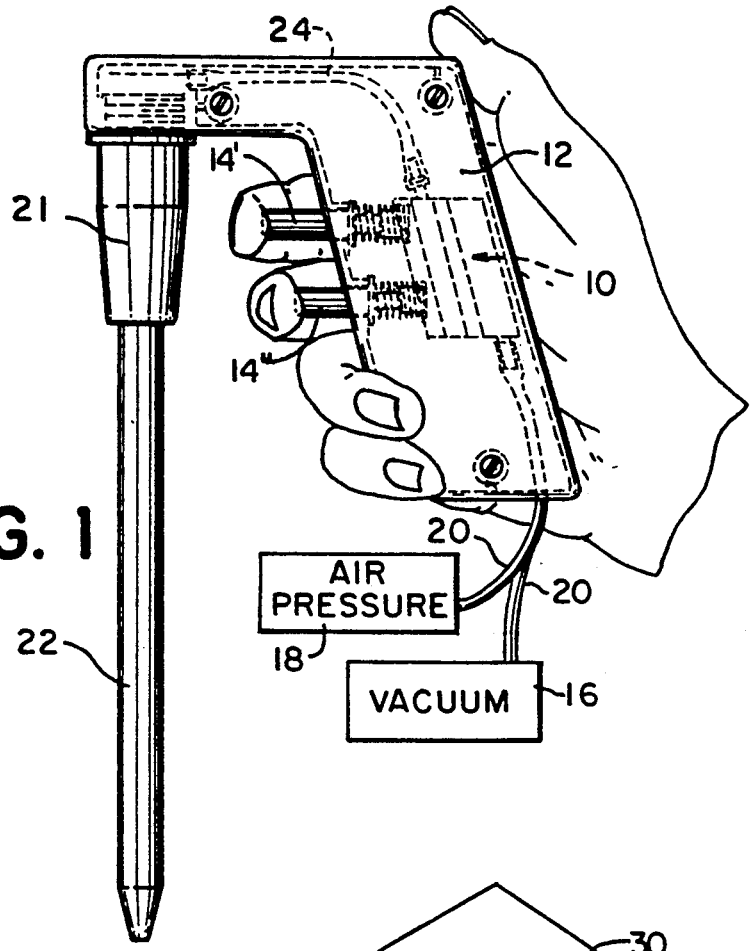
FIG. 1 illustrates a pipette gun in which a valve in accordance with one embodiment of the present invention may be used.

A valve according to one embodiment of the present invention has particular use in a pipette gun such as shown FIG. 1. The valve, denoted generally be reference number 10, is located in the handle 12 of the gun. The valve 10 regulates the flow of pressurized air to a pipette 22 to control the flow of liquid samples through the pipette 22. The valve 10 is connected by separate hoses or flexible tubes 20 to separate sources of negative 16 and positive 18 pressure, and by a single hose or flexible tube 24 to a pipette 22. The valve 10 is equipped with one trigger 14' to control the flow of positive pressure and another trigger 14" to control the flow of negative pressure. Depressing the positive pressure trigger 14' expels liquid from the pipette; depressing the negative pressure trigger 14" draws liquid into the pipette. The pipette gun is provided with a nose piece 21 for receiving and holding the pipette 22 on the gun.

Figure 2:
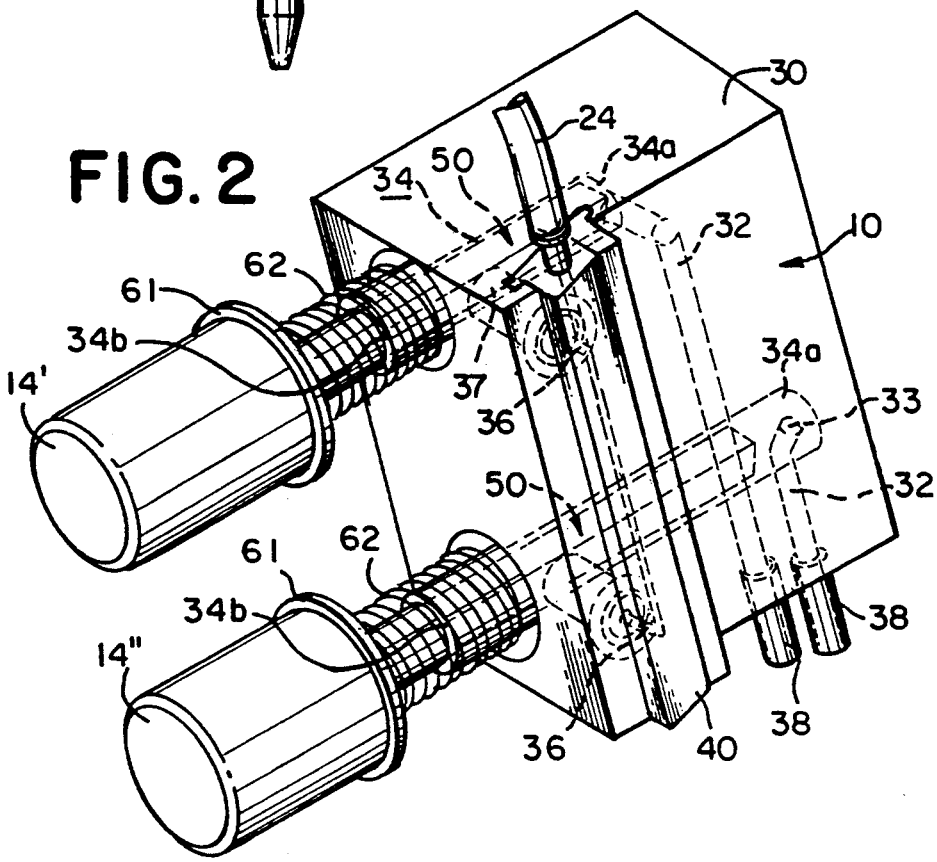
FIG. 2 is an enlarged perspective view of the valve shown in FIG. 1.

Referring to FIG. 2, the valve of the present invention has a pair of valve systems located within a housing 30, each system being constructed substantially the same as the other unless indicated otherwise. In FIGS. 1 and 2, the two valve systems are identified with the same reference characters, but the triggers 14 are given the characters 14' and 14", respectively. One system regulates air flow from the positive pressure source while the other system regulates air flow to the negative pressure source. The valve systems are interconnected by a manifold 40 which, in turn, is connected by a hose or flexible tube 24 to the pipette 22. For clarity and brevity of the description, descriptive reference hereinafter will be made to the system having the trigger 14' which is connected to the positive pressure source.

Each valve system comprises an elongated, cylindrical valve chamber 34 located within the housing 30. A first conduit 32 is connected within the housing to one end **34*a* of the chamber 34 by an opening 33 in the peripheral surface of the chamber. The opening 33 may alternatively be in the end surface of the chamber. The first conduit 32 provides a passage from the chamber 34 to a stem or nipple 38 fixed on the outer surface of the valve housing 30. The stem 38 is designed to receive a hose or flexible tube 20 leading to the air pressure source 18, or vacuum source 16**, as the case may be.

A second conduit 36 is connected within the housing 30 to a medial section of the chamber 34 by a port 37 in the peripheral surface at the mid-section of the chamber 34. While the opening 33 connecting the chamber 34 to the first conduit 32 may be either in the peripheral surface or end surface of the chamber 34, the port 37 must be in the peripheral surface of the chamber 34. The second conduit 36 provides a passage from the chamber 34 to a manifold 40 which is connected to the pipette 22 by a hose or flexible tube 24. The other end **34*b* of the chamber 34 preferably projects beyond the housing 30 and provides an opening to the atmosphere outside the housing. As noted above, the valve has two elongated chambers located generally parallel to one another and constructed similarly. The second conduits 36 of both chambers are connected to the same manifold 40, but the first conduits 32** are separated for connection to either air pressure or vacuum.

An elongated valve element, denoted generally by reference number 50, is designed to slide along the longitudinal axis within the chamber 34. The valve element 50 has a stem 52 connected to an operator 14 for moving the valve element within the chamber 34. The valve stem is inserted from outside the valve housing 30 into the chamber 34 through the other end **34*b*. At its junction with the stem, the operator 14 preferably has a flange 61 to limit the action path of the valve stem 52 into the chamber 34. The flange contacts a stop (not shown) at the other end 34*b* of the chamber (see FIG. 5), thereby defining a first limit position of the valve element within the chamber; the flange also contacts a stop on the handle 12 of the pipette gun (see FIG. 1) thereby defining a second limit position of the valve element outside the chamber. Alternatively, the diameter of the operator 60 may simply be larger than the diameter of the valve stem 52 and the inner diameter of the chamber 34**.

The valve stem 52 preferable has two sections, a sealing section **52*a* proximal to and connected to the operator 14, and an action section 52*b* remote from the operator 14. The sealing section 52*a* preferably has a single continuous cylindrical surface 54 with an outer diameter having a sliding fit in the inner diameter of the chamber 34 easily affording both rotation and linear movement of the stem 52 within the chamber 34. The action section 52*b* preferable has multiple flat surfaces 56 (see FIGS. 3 and 4) with an outer dimension approximately equal to the outer diameter of the sealing section 52*a* of the stem. Each of the flat surfaces 56 has a longitudinal groove 58 shorter than the length of the action section. In the embodiment illustrated in FIGS. 2–6, the action section 52*b* of the valve stem 52 has three flat surfaces 56. Each longitudinal groove 58 has dimensions different than other grooves to provide a different cross-sectional area which provides a longitudinal fluid flow area through the grooves 58, as described hereinafter. The grooves 58** are preferably arranged around the outer surface of the stem in an ordered sequence of increasing size and flow area.

Figure 3:
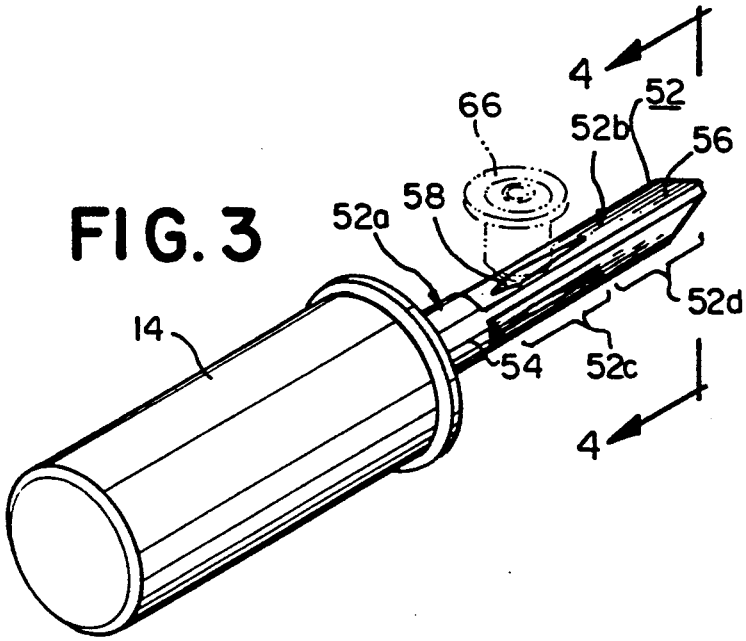
FIG. 3 is an enlarged perspective view of a sliding valve element of FIG. 2 contacting a port sealing device shown in phantom.

Each groove 58 divides each action section **52*b* into two portions, a grooved portion 52*c* and a solid portion 52*d*. As seen in FIG. 3, the grooved portion 52*c* is adjacent the sealing section 52*a* and the solid portion 52*d* is remote from the sealing section 52*a***.

The valve element 52 is designed to both rotate and slide longitudinally within the chamber 34 to regulate the passage of air from the first conduit, through the chamber, and into the second conduit or vice versa, depending upon the relative pressure in the first conduit. The valve element is operable longitudinally between a first limit position completely isolating the second conduit when the trigger or operator 60 is fully released and a second limit position fully connecting the second conduit to the pressure source when the trigger or operator is fully depressed. When the valve element is positioned in between limit positions, it provides limited flow of air to the second conduit when a groove is in registry with the port 37. The flow rate increases as the trigger or operator 14 is more fully depressed.

Figure 4:
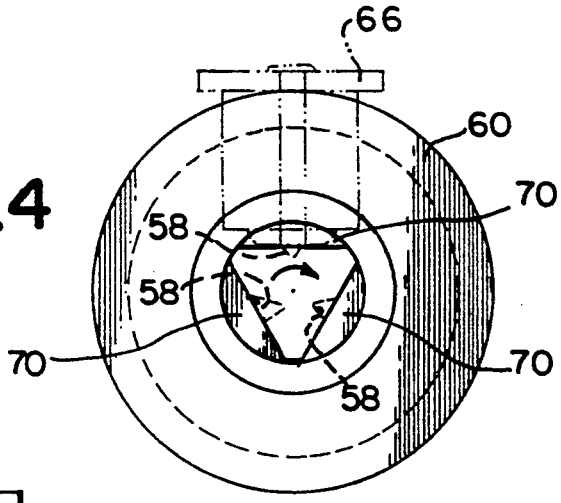
FIG. 4 is an enlarged plan view taken along line 4—4 of FIG. 3.
Figure 5:
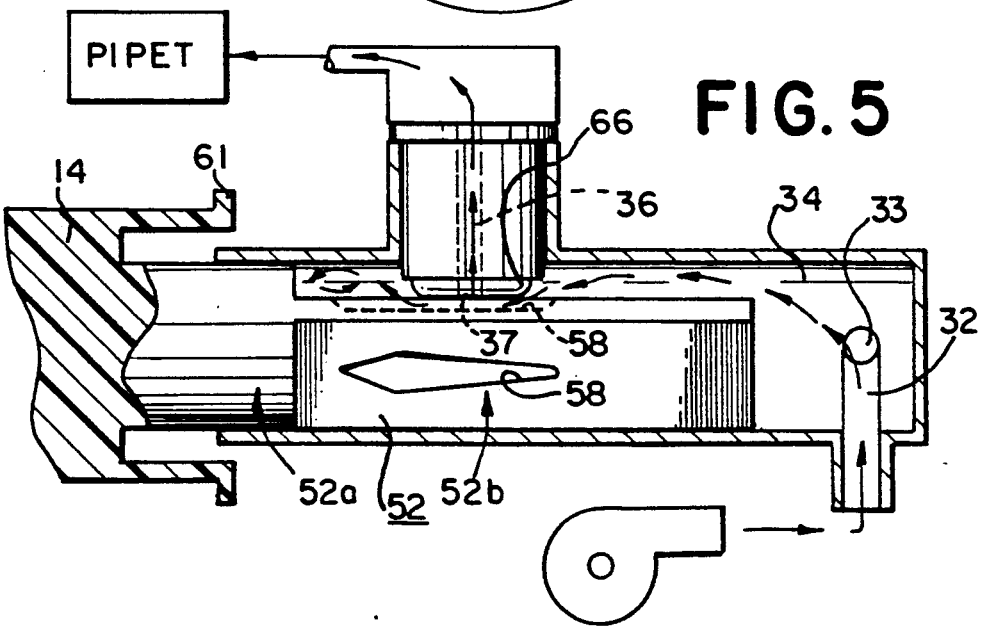
FIG. 5 is a schematic view of the operation of a valve of the present invention in one limit position connecting a pressure source to a pipette.
Figure 6:
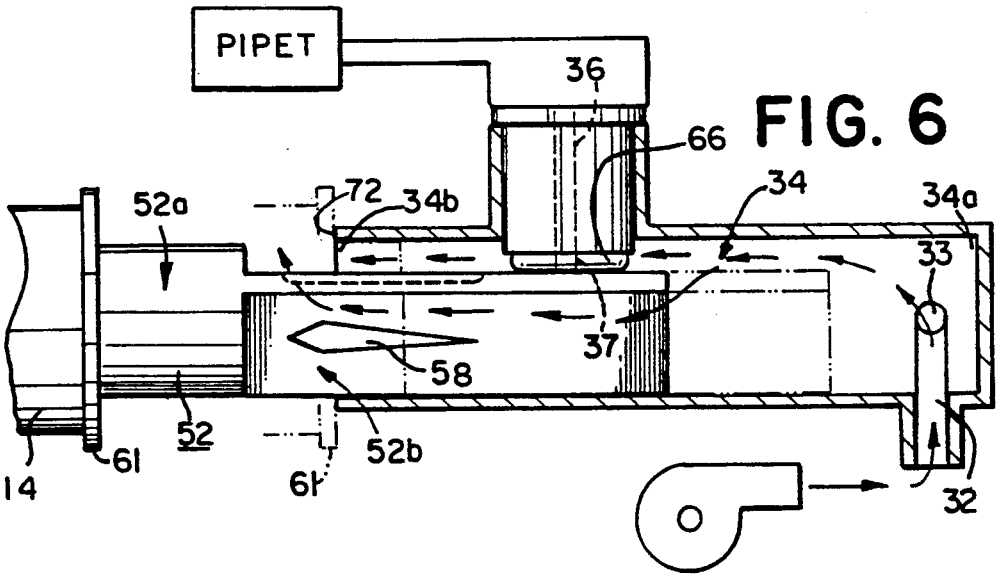
FIG. 6 is a schematic view of the operation of a valve of the present invention in another limit position isolating a pipette from a pressure source.

In the first limit position, the solid portion **52*d* of one of the flat surfaces 56 registers with the port 37 and blocks the flow of air through the port into the second conduit 36, thereby isolating the pipette as best seen in FIG. 6. The port is preferably fitted with an elastomeric annular sealing element 66 to help seal the contact between the port and the solid portion 52*d* of the flat surface 56. In the first limit position, air continuously flows into one end 34*a* of the chamber from the first conduit 32, over the flat surfaces of the stem 56, past the port 37 and its sealing element 66 and out a vent 72 at the other end 34b of the chamber as illustrated by the fluid flow arrows in FIG. 6. As seen in FIG. 4, the action section 52b of the stem 52 provides only partial blockage of the chamber. Air can freely flow through the voids 70 surrounding the action section of the stem and out the vent 72. In a preferred embodiment, when the sealing section 52a is disengaged from the chamber 34 (see FIG. 6), the other end 34b of the chamber forms the vent creating an opening in the chamber to the surroundings. Alternatively, the vent may comprise an opening in the peripheral surface of the chamber near the other end 34b. In either case, the sealing section 52a of the stem contacts and closes the vent when the stem is displaced longitudinally inwardly in the direction shown in FIG. 5**.

In the second limit position the valve stem is urged inwardly in the direction shown in FIG. 5 until the flange 61 contacts a stop (not shown) near the end of the chamber. As the valve stem slides toward the second limit position, the grooved portion of the stem passes into contact with the sealing element 66 of the port until one of the grooves is in registry with the port to provide an air flow passage into the second conduit through the open center of the sealing element 66. The sealing section 52a simultaneously slides into contact with and seals the vent 72. Air entering the chamber from the first conduit flows over each of the flat surfaces, including the flat surface contacting the port. Since the vent is closed by the sealing section 52a, air is forced to flow through the longitudinal groove 58, through the port 37 and into the second conduit 36 as illustrated by the fluid flow arrows in FIG. 5.

As seen in FIGS. 3–5, the groove is tapered both longitudinally and depthwise thereby providing a different fluid flow area depending on the position of the groove in contact with the sealing element 66 of the port 37. As the valve stem is displaced inwardly from its first limit position towards its second limit position, an increasingly larger section of the groove is in registry with the port, thereby increasing the flow of pressurized air to the pipette. With this construction, the flow of liquid through the pipette can be regulated by controlling the depth to which the operator 14 or trigger of the gun is depressed. The valve provides maximum air flow to the pipette in its second limit or fully depressed position. The valve provides no air flow to the pipette in its first or extended position. A compression spring 62 (see FIGS. 1 and 2) is provided on the operator to normally urge the operator or trigger 14 to an extended position.

Each flat surface 56 on the valve stem 52 provides a predetermined range of air flow rates by limiting the dimensions of its corresponding groove. Each surface has a tapered groove with dimensions different from the other to provide a different range of flow rates, each ranging from zero to a different maximum flow rate. As the valve stem is rotated within the chamber 34, a different flat surface 56 and corresponding tapered groove 58 contacts the sealing element 66 of the port 37. In a preferred embodiment, the compressible elastomeric sealing element 66 acts as a detent to selectively position and hold one of the flat surfaces 56 in confronting relation with the port 37 as the element is rotated within the chamber 34. Each flat surface represents a predetermined setting with a preset range of flow rates and predetermined sensitivity in the trigger or operator 60.

Figure 7:
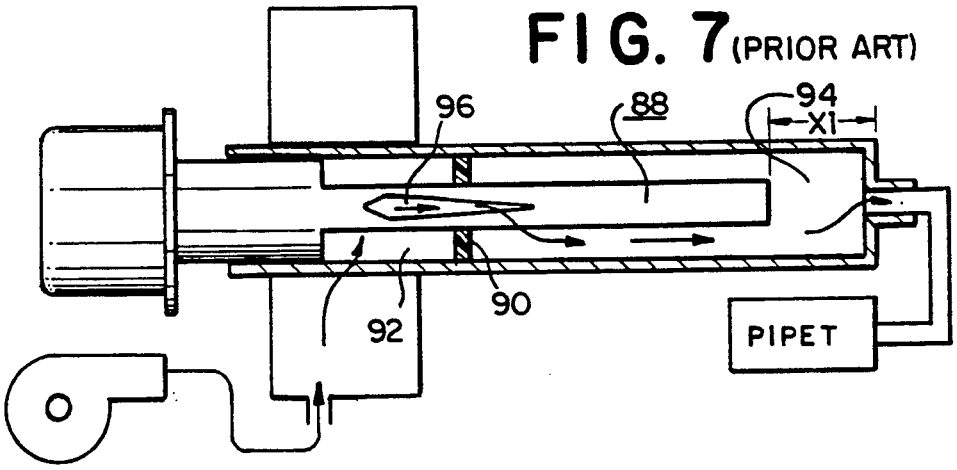
FIG. 7 (PRIOR ART)
FIGS. 7 and 8 are schematic views of the operation of a prior art valve which creates the "piston effect".
Figure 8:
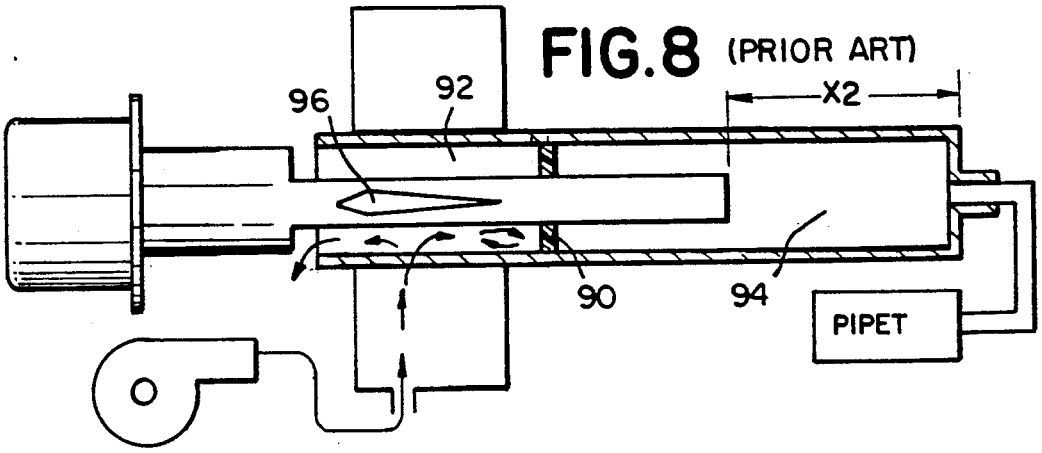
FIG. 8 (PRIOR ART)

The valve of the illustrated embodiment of the present invention eliminates the "piston affect" which makes precise metering in small pipettes very difficult using prior art valves. A prior art valve is shown schematically in FIGS. 7 and 8. In the illustrated prior art, a valve element 88 having a single longitudinal groove 96 slides between a first limit position, shown in FIG. 8 isolating the pipette chamber 94 from the supply chamber 92, to a second limit position providing a passage from the supply chamber 92 to the pipette chamber 94 through a sealing element 90 through the longitudinal groove 96 in the valve element. When depressing the trigger inwardly, the valve element increases the pressure in the pipette chamber 94 even before the groove is registered due to the volume of air displaced by the valve itself. Conversely, when releasing the trigger, the valve element moves from the position shown at X1 in FIG. 7 to the position X2 shown in FIG. 8, decreasing the pressure in the pipette chamber after the groove is out of registry due to the vacuum created by the valve itself. The movement of the valve displaces a volume of air equal the cross sectional area of the valve stem times the change in the distance, (X2−X1), shown in FIGS. 7 and 8.

The valve of the present invention eliminates the "piston effect" of the prior art valves since the valve element does not enter the second conduit while moving into and out of registry with the port. The pressure change associated with the sliding valve stem is absorbed by the first conduit which is connected to the constant pressure source and not the pipette.

While a preferred embodiment of the valve of the present invention is provided with three flat surfaces in a triangular cross-sectional configuration, it is recognized to provide a different number, two or four for example, with a corresponding change in cross-sectional configuration. Other embodiments of the present invention may provide a valve element having a single continuous surface or several longitudinal grooves and an external or a remote internal detent.

The valve body is preferably made of a liquid crystal polymer. The valve body will preferably be injection molded requiring no drilling. The valve stem is preferably made of a material having a low coefficient of friction and which will not be attacked in a biological or chemical laboratory environment. A preferred material for the valve element is polytetrafluoroethylene. The compressible elastomeric sealing element is preferably made of Buna N rubber or any elastomeric material which will not be attacked in a laboratory environment. The end of the sealing element 66 which contacts the flat surface of the valve stem is preferably fitted with a ½ shaped "O-ring" to reduce sliding friction between the valve stem and the sealing element.

While particular embodiments of the present invention are herein illustrated and described, the present invention is not limited to these particular embodiments and changes and modifications may be made therein and thereto within the scope of the following claims.

I claim:

1. A valve for use in a pipette gun for variably controlling the flow of liquid samples into and out of a pipette, comprising:

a housing;

a first conduit located in said housing constructed and arranged to be connected to a fluid pressure source;

a second conduit located in said housing constructed and arranged to be connected to a pipette and to contain a volume of fluid;

an elongated valve chamber within said housing having a length, an inner diameter, a longitudinal axis, and a peripheral surface, said chamber having one opening connecting said first conduit with said chamber, and port means extending inwardly from the peripheral surface connecting said second conduit with said chamber;

an elongated valve element having a length, an outer surface, and an outer dimension constructed and arranged to slide along said longitudinal axis within said chamber with said outer surface in confronting sealing engagement with said port means, said valve element having an axial, longitudinal groove in the outer surface shorter than the length of said valve element and operable to register with said port means;

an operator connected to said valve element at one end for moving said groove of said valve element into and out of registry with said port means, said groove providing a fluid passage through said sealing engagement of said outer surface with said port means connecting said first and second conduits when said groove is in registry with said port means, and said valve element isolating said second conduit when said groove is out of registry with said port means, whereby the port means separates the second conduit from the chamber so that the volume of fluid in said second conduit remains substantially unchanged while said groove is moving into and out of registry with said port means.

2. A valve according to claim 1 wherein said longitudinal groove is tapered, said groove providing an adjustable fluid flow area in said fluid passages between said first and second conduits.

3. A valve according to claim 1 wherein said valve element has multiple surfaces on said outer surface, said operator operable to displace said element to cause said multiple surfaces to alternatively confront said port means, each of said surfaces having a longitudinal groove.

4. A valve according to claim 3 wherein each of said grooves has a different size and provides a different fluid flow area than the other, said grooves being arranged in an ordered sequence of increasing size around the outer surface of said valve element, said element being rotatable about its longitudinal axis to effect said alternative confrontation.

5. A valve according to claim 3 wherein said port means comprises an elastomeric sealing element to seat against one of said multiple surfaces and to provide sealed fluid communication between said port and said groove.

6. A valve according to claim 3 wherein the outer dimension of said valve element is less than the valve chamber inner diameter to allow rotation of said valve element about its longitudinal axis in said chamber and confront said port means with one of said multiple surfaces.

7. A valve according to claim 6 having detent means for selectively positioning and holding one of said multiple surfaces in confrontation with said port means.

8. A valve according to claim 7 wherein said detent means comprises an elastomeric sealing element positioned in said port means to resiliently bear against said surface and compressible by rotation of said valve element about the longitudinal axis to seat against a selected one of said surfaces and to provide fluid communication between said port and said groove through said sealing element.

9. A valve according to claim 1 wherein said valve element has multiple longitudinal grooves on the outer surface, each of said grooves having a size and providing a fluid flow area different than the other.

10. A valve according to claim 9 wherein the outer dimension of said valve element is less that the valve chamber inner diameter to allow rotation of said valve element about its longitudinal axis in said chamber to align one of said grooves for registry with said port.

11. A valve according to claim 9 having a detent for selectively positioning and holding said valve element aligned for registry of one of said grooves with said port.

12. A valve according to claim 1 wherein said valve element has a sealing section, an action section, a first end proximal to said operator, and a second end remote from said operator, said sealing section measured from said first end to an intermediate point having a constant dimension providing a sliding fit in said valve chamber, said action section measured from said intermediate point to said second end and having multiple surfaces with a maximum outer dimension not greater than the constant dimension of said sealing section.

13. A valve according to claim 12 wherein each of said multiple surfaces has a longitudinal groove shorter than the action section, said grooves defining a grooved portion of the action section and a solid portion of the action section.

14. A valve according to claim 13 wherein said valve chamber has a vent connecting said chamber with the surroundings of the valve housing when said groove is out of registry with said port, said sealing section being positioned relative to said groove to seal said vent and isolate said chamber from the surroundings when said groove is in registry with said port.

15. A valve according to claim 14 wherein at least one of said multiple surfaces defines a path of fluid flow from said first conduit to said vent when said groove is out of registry with said port.

16. A valve according to claim 14 wherein said vent comprises one end of said chamber.

17. A valve for use in a pipette gun for variably controlling the flow of liquid samples into and out of a pipette, comprising:

an elongated valve chamber within a housing having a longitudinal axis, a peripheral surface, first flow means connectable with the pipette providing fluid flow between the pipette and said chamber, and second flow means connecting a source of pressure fluid with said chamber, one of said flow means comprising a port extending inwardly from said peripheral surface;

an elongated valve element having a longitudinal action section in said chamber with an outer surface constructed and arranged to slide along said longitudinal axis within said chamber with said outer surface in engagement with said port, in at least one position said outer surface being in confronting sealing engagement with said port, said valve element having an axial, longitudinally-tapered groove in the outer surface and operable to register with said port; and means for slidably displacing said element longitudinally to move said groove of said valve element into and out of registry with said port, said groove providing a fluid passage through sealing engagement of said outer surface with said port connecting said source and said pipette when said groove is in registry with said port, and closing said passage when said groove is out of registry with said port.

18. A valve according to claim 17 wherein said port comprises an annular seat having a seat surface engaging said outer surface and a central bore in said seat surface forming a passage, said groove affording fluid flow along the length of said valve element between said chamber and said central bore to comprise said fluid passage between said source and said conduit.

19. A valve according to claim 18 wherein said valve element has a plurality longitudinally tapered grooves about the perimeter of said outer surface, said grooves being of different sizes to provide flow passages of different sizes, and means to rotate said action section about the longitudinal axis of the chamber to register a selected one of said plurality of grooves with said seat surface.

20. A valve according to claim 19 wherein the outer surface of the action section is flat alongside said tapered groove, and said seat surface comprises an elastomeric annular element having a flat surface to slidably engage the flat surface outer surface of the action section alongside said tapered groove.

* * * * *